US010028548B2

(12) United States Patent
Wily et al.

(10) Patent No.: US 10,028,548 B2
(45) Date of Patent: Jul. 24, 2018

(54) TODDLER SHOE WITH SQUEAKER

(71) Applicant: Sewell Development Corporation, Provo, UT (US)

(72) Inventors: R. Preston Wily, Lehi, UT (US); Song Jin Yu, Cao He Town (CN); Cameron Postelwait, Lehi, UT (US)

(73) Assignee: Sewell Development Corporation, Provo, UT (US)

( * ) Notice: Subject to any disclaimer, the term of this patent is extended or adjusted under 35 U.S.C. 154(b) by 240 days.

(21) Appl. No.: 15/050,261

(22) Filed: Feb. 22, 2016

(65) Prior Publication Data

US 2016/0242495 A1 Aug. 25, 2016

Related U.S. Application Data

(60) Provisional application No. 62/118,873, filed on Feb. 20, 2015.

(51) Int. Cl.
*A43B 3/00* (2006.01)
*A43B 3/30* (2006.01)

(52) U.S. Cl.
CPC ..... *A43B 3/30* (2013.01); *A43B 3/00* (2013.01); *A43B 3/0021* (2013.01)

(58) Field of Classification Search
CPC ..... A43B 3/0021; A43B 7/06; A43B 7/08; A43B 7/082; A63H 3/31; A63H 5/00
USPC ..... 36/3 R, 3 B, 136, 139
See application file for complete search history.

(56) References Cited

U.S. PATENT DOCUMENTS 847,240 A * 3/1907 Chamberlain ..... A63H 33/00 36/139
2,302,318 A * 11/1942 Henry ..... A63H 5/00 446/196
2,721,420 A * 10/1955 Chatten ..... A43B 3/30 116/67 R
3,002,318 A * 10/1961 Carver ..... A63H 5/00 446/144
3,340,846 A * 9/1967 Magiera ..... G10K 5/00 116/67 R
3,928,935 A * 12/1975 Beadles, Jr. ..... A63H 5/00 446/208
4,253,254 A * 3/1981 Gill ..... A43B 3/00 36/139
4,711,043 A * 12/1987 Johnson ..... A43B 23/00 36/139
5,285,585 A * 2/1994 Baker ..... A43B 3/30 36/112
5,421,107 A * 6/1995 Bryan ..... A43B 3/00 36/112
5,433,437 A * 7/1995 Dudley ..... A63B 69/002 36/139
5,845,335 A * 12/1998 Twitty ..... A41D 11/00 2/125

(Continued)

*Primary Examiner* — Marie Bays
(74) *Attorney, Agent, or Firm* — Kirton McConkie; Adam D. Stevens

(57) ABSTRACT

A toddler shoe has a squeaker or other air-powered noise-maker (collectively "squeaker") that is selectively active in that the squeaker can be turned on or off. The squeaker can be turned on or off without removing the squeaker from the shoe, and because the squeaker remains in the shoe, the functional characteristics of the shoe are unaffected by the on or off state of the squeaker.

16 Claims, 5 Drawing Sheets

(56) References Cited

U.S. PATENT DOCUMENTS

| | | | | |
|---|---|---|---|---|
| 6,000,149 | A * | 12/1999 | Pomerantz | A43B 3/00 36/136 |
| 6,681,504 | B2 * | 1/2004 | Kinan | A43B 1/0036 36/112 |
| 2002/0086608 | A1 * | 7/2002 | Chu | A63H 5/00 446/200 |
| 2005/0176343 | A1 * | 8/2005 | Szekely | A63H 5/00 446/416 |

* cited by examiner

TODDLER SHOE WITH SQUEAKER

BACKGROUND OF THE INVENTION

1. Field of the Invention

The present invention relates to toddler shoes, and more particularly to toddler shoes with squeakers that can be turned on or off.

2. Background and Related Art

Toddlers are young children who are in the process of learning to walk. Parents of toddlers often wish to protect their children's feet, and may use shoes to do so. Shoes may also serve an ornamental purpose. Some toddler shoes may include a squeaker or other noisemaker, commonly in the heel portion of the sole of the shoe. The squeaker or other noisemaker provides aural feedback to the toddler when the toddler walks, which is believed to encourage toddlers to walk and further serves to alert nearby adults as to the location of the child.

Existing shoe designs that incorporate squeakers or other noisemakers have certain problems. While the squeaker or other noisemaker can be fun or assistive at times, it can be distractive and unwanted at others. If the squeaker or other noisemaker is not removable, parents or caregivers can find the noise tiresome over time, or inappropriate in certain circumstances. Some manufacturers have turned to making the squeaker or other noisemaker removable. Having the squeaker or other noisemaker removable, however, may affect the functional characteristics of the shoe, potentially leading to instability or other problems.

BRIEF SUMMARY OF THE INVENTION

A toddler shoe having a squeaker or other air-powered noisemaker (collectively "squeaker") is described. The squeaker is selectively active in that the squeaker can be turned on or off. The squeaker can be turned on or off without removing the squeaker from the shoe, and because the squeaker remains in the shoe, the functional characteristics of the shoe are unaffected by the on or off state of the squeaker.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

A toddler shoe having a squeaker or other air-powered noisemaker is described herein with reference to the Figures. In the description and claims, the term "squeaker" refers to a squeaker as commonly used in toddler shoes, or any other similar air-powered noisemaking device wherein noise is made by the movement of air driven by the walking motion of the shoe wearer. The squeaker is selectively active in that the squeaker can be turned on or off. The squeaker can be turned on or off without removing the squeaker from the shoe, and because the squeaker remains in the shoe, the functional characteristics of the shoe are unaffected by the on or off state of the squeaker.

Figure 1:
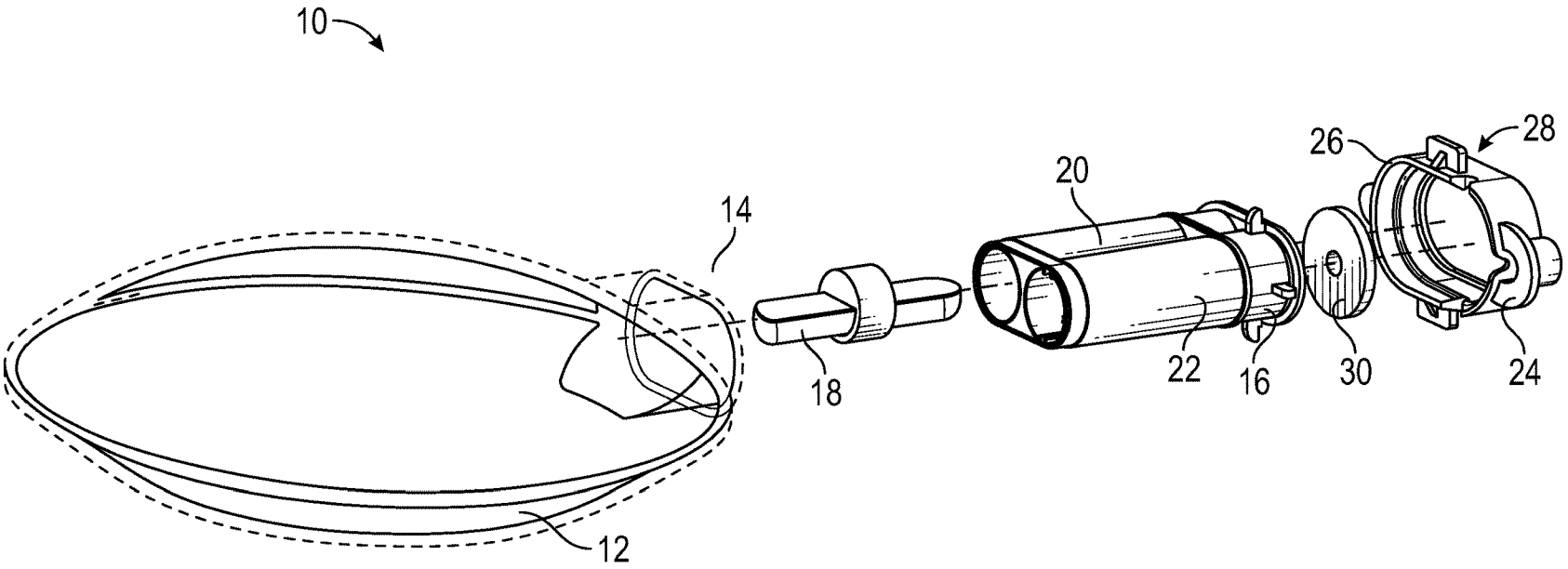
FIG. 1 shows a perspective exploded view of functional components of an exemplary squeaker mechanism having an on-off capability.

FIG. 1 shows an exploded perspective view of the functional components of a squeaker 10. The squeaker 10 includes an air reservoir 12. The air reservoir 12 forms a chamber that holds a volume of air when the air reservoir 12 is in a normal inflated state as shown in FIG. 1. As is known in the art of air-powered noisemakers, the air reservoir 12 may be formed or configured to naturally assume the normal inflated state shown in FIG. 1 by any of a variety of methods, including by proper selection of the material from which the air reservoir 12 is formed such that the material of the air reservoir 12 naturally biases the air reservoir 12 to the normal inflated state. The inflated state can also be made the normal state of the air reservoir 12 by including an expanding device such as a spring, or an expanding material such as foam within the air reservoir 12. Any other method for causing the air reservoir 12 to be naturally biased to the normal inflated state of FIG. 1 is embraced by the embodiments of the invention.

The air reservoir 12 may be manufactured of any of a variety of durable flexible materials, including a variety of plastic materials. The air reservoir 12 is placed in the sole of the shoe, so as to be located approximately centered beneath the heel of the wearer's foot when the shoe is worn. In this way, when the wearer's heel strikes the ground, the weight of the wearer forcibly expels the air from the air reservoir 12 through an outlet 14 thereof. When the user's weight is removed from the heel of the shoe, the pressure on the air reservoir 12 is removed, and as the air reservoir 12 is biased to the normally inflated state, the bias causes the air reservoir 12 to draw air back in through the outlet 14 (or through a separate inlet) as the air reservoir 12 is reinflated in preparation for the wearer's next step.

As the air passes in and/or out of the air reservoir 12, it passes through a double-chambered air tunnel 16. The air tunnel 16 serves to guide the air as it flows in and out of the air reservoir 12. The air tunnel 16 also serves to secure and contain a reed 18 within a first chamber 20 of the air tunnel 16. The second chamber 22 of the air tunnel 16 is empty. Thus, when air flows in at least one direction through the first chamber 20 of the air tunnel 16, the reed 18 is activated by the air, causing a noise (e.g. the squeak) to be generated, but when air flows through the second chamber 22 of the air tunnel 16, the reed 18 is not activated and no noise is generated. The air tunnel 16 may be formed of any appropriate material, including any of a variety of plastics, and will generally be substantially rigid or at least significantly more rigid than the air reservoir 12.

As may be seen in FIG. 1, the reed 18 may be a double-sided reed, being thus configured to make a noise when air moves in both directions. The sides of the reed 18 may be differently formed so as to make different sounds or have different tones corresponding to the different directions of air movement. Alternatively, a single-sided reed 18 may be used, whereby the shoe would only squeak when either air is expelled from the air reservoir 12 or when air is taken into the air reservoir 12. It should be noted that for toddler shoes, it is generally accepted that the noise should be made at the time of the heel striking the ground, so when a single-sided reed 18 is used, the reed 18 would be oriented to make noise when air is expelled from the air reservoir 12.

As the squeaker 10 is assembled, the reed 18 is located in and affixed to one end of the first chamber 20 of the air tunnel 16, and then the end of the air tunnel 16 having the reed 18 therein is inserted into and/or affixed to the outlet 14 of the air chamber 12. The other end of the air tunnel 16 is covered by a cap 24. The cap 24 is approximately oblong in shape has an inner broad opening 26 and an outer narrow opening 28. In one embodiment of the cap 24, between the inner broad opening 26 and the outer narrow opening 28, the cap 24 has a cover portion having internal dimensions slightly smaller than the inner dimensions of the inner broad opening 26 and somewhat larger than the inner dimensions of the outer narrow opening 28. In another embodiment of the cap, a slight circumferential ridge is formed on the inner surface of the cap 24 between the inner broad opening 26 and the outer narrow opening 28.

In fashions such as these, when the cap 24 is assembled to the air tunnel 16, a space is formed between the inner surface of the outer narrow opening 28 and the end of the air tunnel 16. This space is occupied by a disk-shaped cover 30. The cover 30 is sized and configured to be more or less snugly contained within the space between the inner surface of the outer narrow opening 28 and the end of the air tunnel 16, but to be capable of sliding movement within the oblong space thus formed, such that the cover 30 may be moved between a position substantially obstructing the outer end of the first chamber 20 of the air tunnel 16 and a position substantially obstructing the outer end of the second chamber 22 of the air tunnel 16. The position of the cover 30 thus serves to determine whether the squeaker 10 is on or off. When the cover 30 is positioned over the first chamber 20, the squeaker 10 is off, and when the cover 30 is positioned over the second chamber 20, the squeaker 10 is on.

Alternatively, the cap 24 may be sized to be wider than the cap 24 shown in FIG. 1, so as to permit retention of a modified cover 30 therein. In such an embodiment, the modified cover 30 may be oblong and may include a hole that may be selectively positioned over the outer end of the first chamber 20 of the air tunnel 16 or over the outer end of the second chamber 22 of the air tunnel 16. Thus, in similar but opposite fashion, the position of the modified cover 30 serves to determine whether the squeaker 10 is on or off: when the hole of the modified cover 30 is positioned over the first chamber 20, the squeaker is on, and when the hole of the modified cover 30 is positioned over the second chamber 22, the squeaker is off. It will be recognized that a modified cover of this style could be used with an air tunnel 16 having more than two chambers to allow multiple "on" states having different generated sounds, such as a squeaker having "off," "quiet," and "loud" states, etc.

The cover 30 may include an indentation or even a small hole to permit manipulation of the cover 30 from outside the shoe using an object with a moderate point, such as a standard ballpoint pen. Because the cover 30 is larger than the outer narrow opening 28, there is little to no chance that the cover 30 could be dislodged from the squeaker 10 when the squeaker 10 is assembled and located in the shoe, so there are no small loose objects that could become choking hazards.

Figure 2:
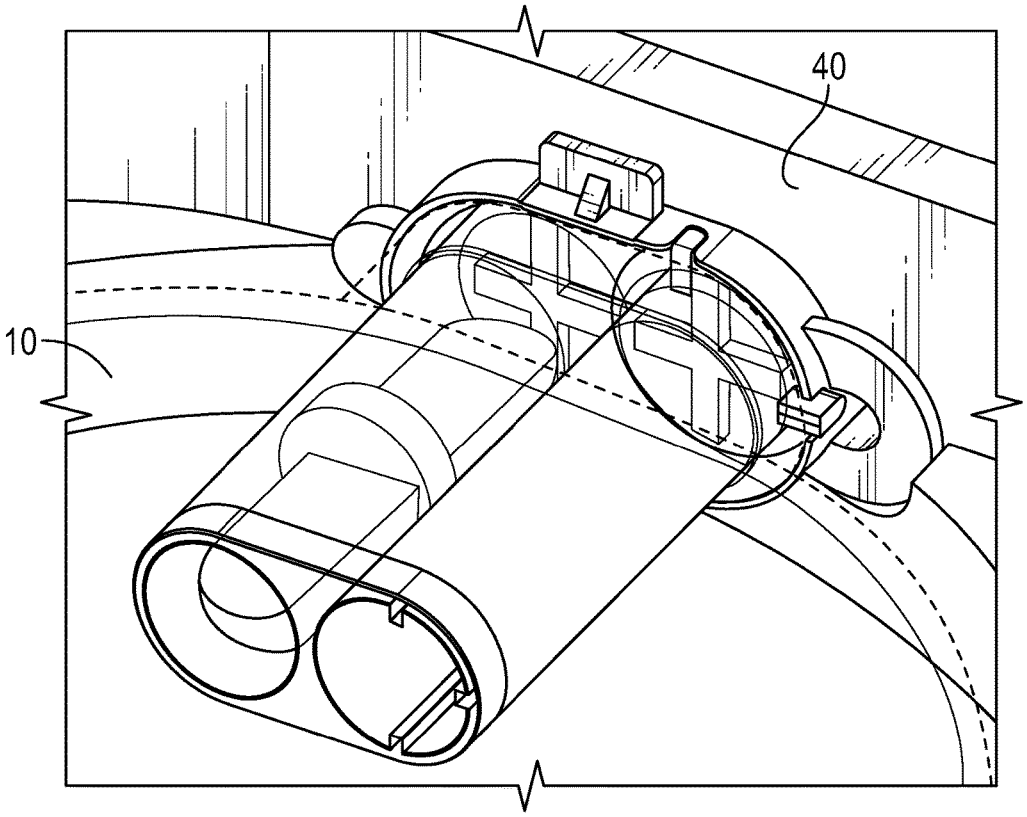
FIG. 2 shows a partially-transparent inner perspective view of the assembled squeaker of FIG. 1.
Figure 3:
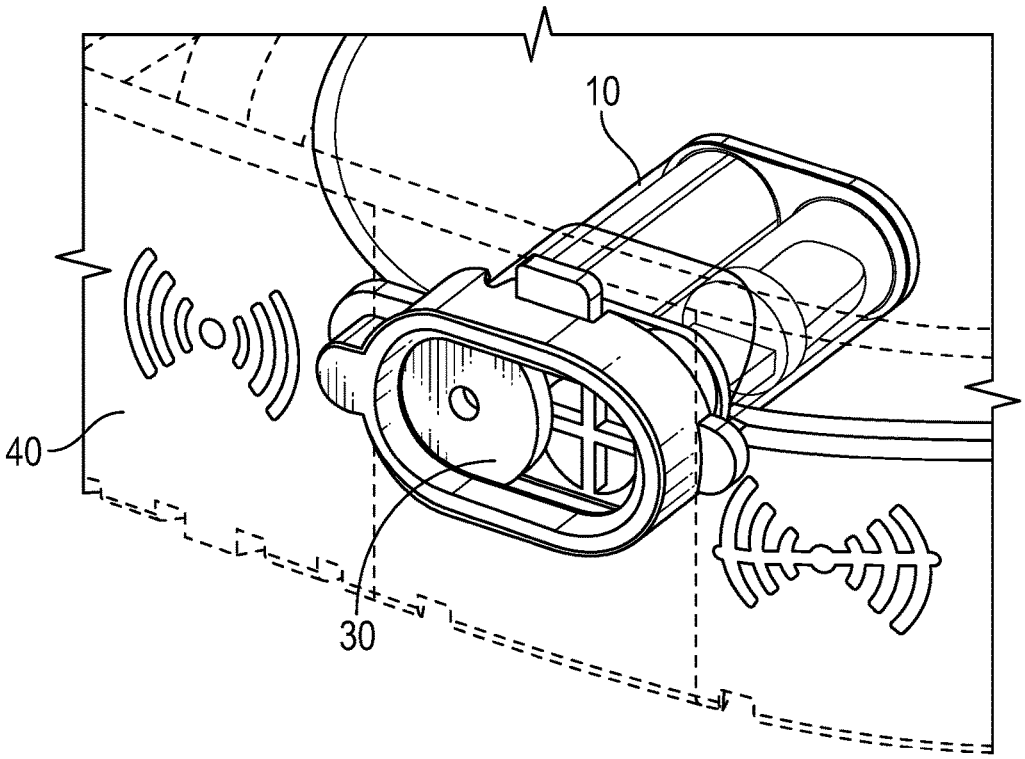
FIG. 3 shows a partially-transparent outer perspective view of the assembled squeaker of FIG. 1 in the "on" position.
Figure 4:
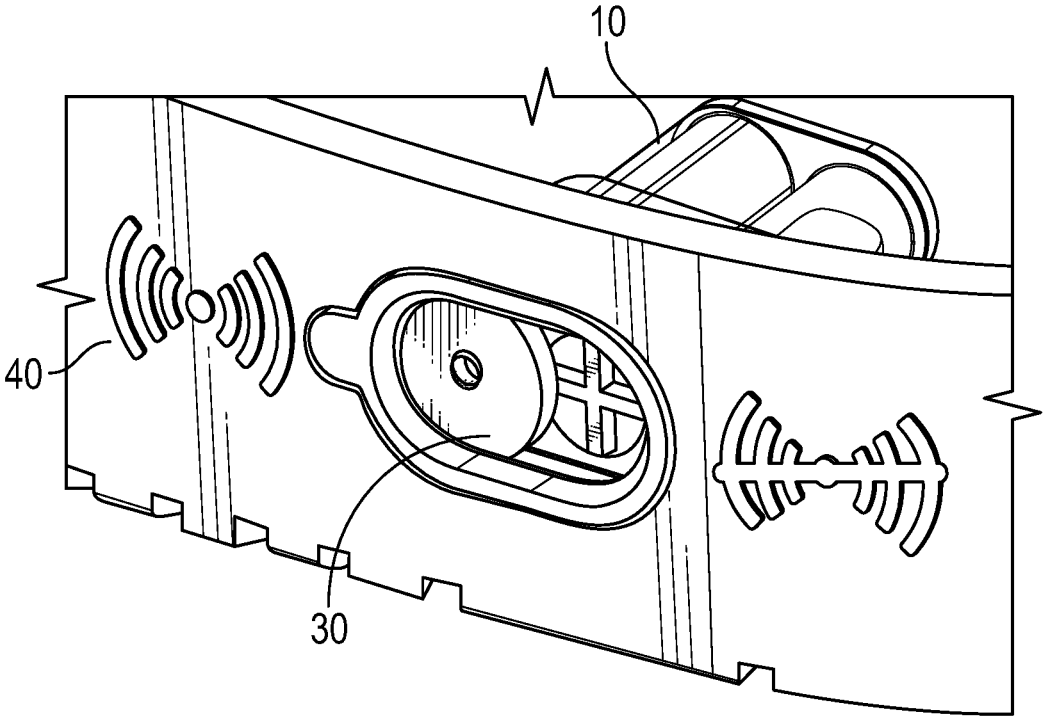
FIG. 4 shows a partially-transparent outer perspective view of the assembled squeaker of FIG. 1 in the "on" position.

The functionality of the squeaker may be illustrated with reference to FIGS. 2-4. FIG. 2 shows a partially-transparent view of a portion of the squeaker 10 of FIG. 1 looking outward, with an outermost portion of the squeaker 10 being embedded in a wall 40 of the heel of the shoe. FIG. 3 shows a partially-transparent view looking inward with the wall 40 being shown in outline only, while FIG. 4 shows a partially-transparent view where the wall 40 is opaque. As may be seen in FIGS. 2-4, the positioning of the squeaker 10 locates the outer narrow opening 28 and the cover 30 in a discrete location where it can be easily manipulated by an adult, but not readily manipulated by a small child. Thus, the adult can set the squeaker 10 to the on or off position, and know that the child will not change the setting. Thus, for example, if the child is to be at a formal event (such as a wedding), he or she can still wear his or her favorite shoes, but the squeaker can be turned off without modifying the look or feel of the shoes, or its functional characteristics. Indeed, the second chamber 22 may be formed to have air flow characteristics that essentially match the air flow characteristics of the first chamber 20, even though no reed 18 is present in the second chamber 22.

Figure 5:
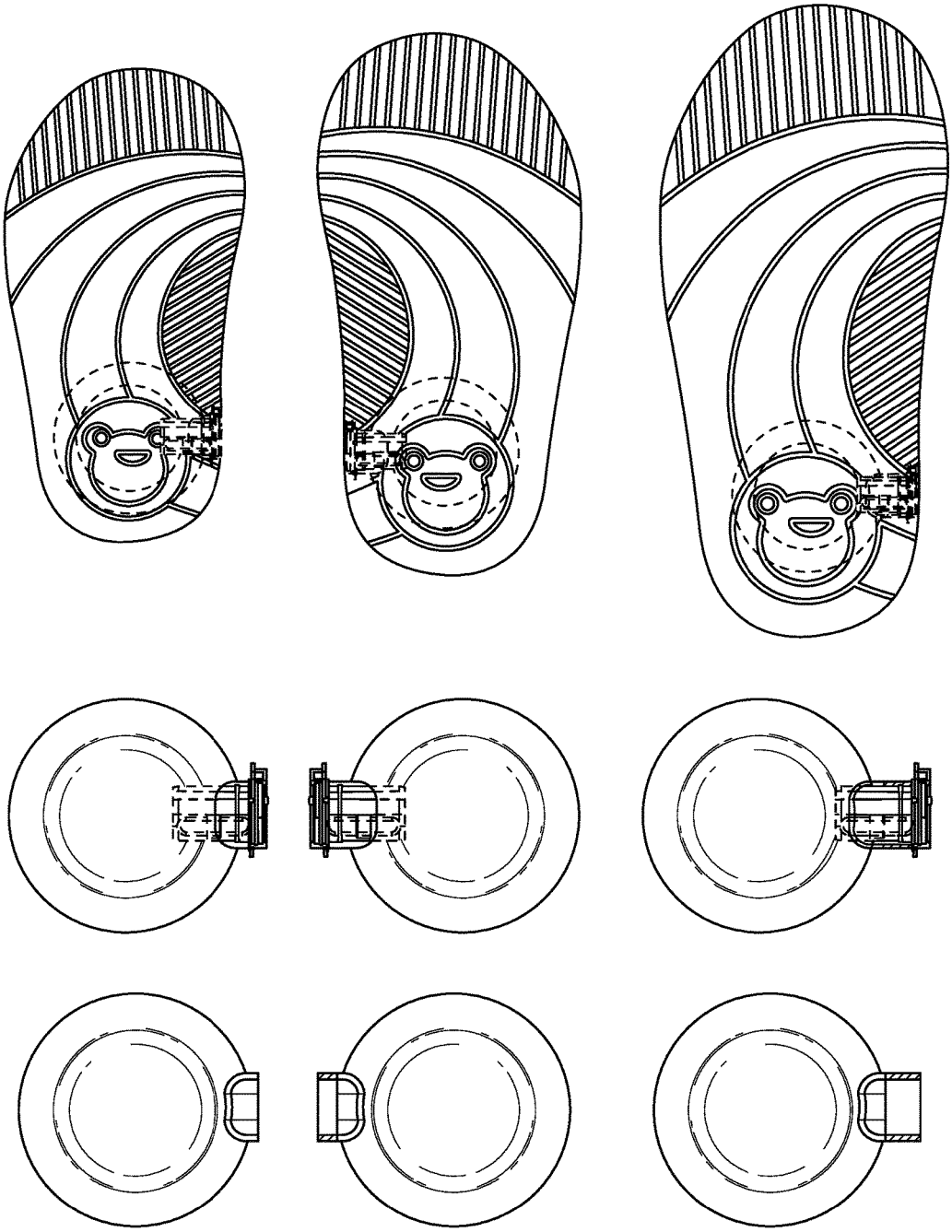
FIG. 5 illustrates variations in sizing that may be utilized with certain embodiments to accommodate various foot sizes while keeping an air reservoir centered under the wearer's heel.

FIG. 5 illustrates modifications of the squeaker 10 that may be taken to account for various sizes of shoe. In the examples of FIG. 5, the size/volume of the air reservoir 12 remains the same, but the air tunnel 16 is lengthened for larger sizes of shoe, while the air tunnel 16 is shortened for smaller sizes of shoe. Alternatively, an extension connecting the air reservoir 12 to the air tunnel 16 may be modified in size for different sizes of shoes. Such extension may be integrally formed with the air reservoir 12 or may be separately attached thereto. These variations and variations such as these allow the same components of the squeaker 10 to be used for all sizes of shoe, other than the various sizes of the air tunnel 16 or other modified component. Meanwhile, the outer narrow opening remains at the same location on the wall 40, and also the air reservoir 12 remains centered under the heel for maximum activation. Alternatively, the size of the air reservoir 12 may be enlarged for larger shoes. Still alternatively, the external opening of the squeaker may be more recessed in larger sizes of shoes. Such alternations similarly ensure that the air reservoir 12 remains centered under the heel for maximum activation.

While the foregoing description discusses an example of a toddler shoe having a dual-chamber air tunnel 16 and a cover 30 that selectively covers one of the first chamber 20 and the second chamber 22, other embodiments are envisioned. For example, the air tunnel 16 could be modified to have more than two chambers, and the cover 30 could be modified to cover the opening of one or more than one available chamber. Alternatively, multiple covers 30 could be provided. Differing reeds could be located in the various chambers, and the movement of the cover 30 or covers 30 could vary between shutting off the squeaker 10 entirely, allowing a first noise to sound, allowing a second noise to sound, allowing multiple noises to sound, etc. according to the number of chambers and associated noisemakers.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A shoe having a squeaker therein, wherein the squeaker can be selectively turned on and off, the squeaker comprising:

an air reservoir having an outlet;

an air tunnel comprising:

a first end operatively connected to the air reservoir;

a second end; and a plurality of chambers therethrough, each with a first opening at the first end and a second opening at the second end, wherein a first chamber has an air-actuated noisemaking device therein, and wherein a second chamber contains no noisemaking device; and a cover positioned at the second end and configured to selectively and alternatively cover the second opening of one of the chambers such that air only flows through any chamber having a second opening not substantially covered by the cover.

2. The shoe as recited in claim 1, wherein the squeaker is on when the cover is positioned over the second opening of the second chamber and wherein the squeaker is off when the cover is positioned over the second opening of the first chamber.

3. The shoe as recited in claim 1, wherein the noisemaking device comprises a reed.

4. The shoe as recited in claim 3, wherein the reed is a bidirectional reed.

5. The shoe as recited in claim 1, wherein the cover is slidingly retained within a portion of a cap covering the second end of the air tunnel.

6. The shoe as recited in claim 1, wherein the squeaker is located in a heel portion of a sole of the shoe.

7. The shoe as recited in claim 6, wherein the air reservoir is centered in a heel portion of the shoe.

8. The shoe as recited in claim 1, wherein the air tunnel comprises two chambers.

9. A shoe having a squeaker therein, wherein the squeaker can be selectively turned on and off, the squeaker comprising:

an air reservoir having an outlet;

an air tunnel comprising:

a first end operatively connected to the air reservoir;

a second end; and a plurality of chambers therethrough, each with a first opening at the first end and a second opening at the second end, wherein the first opening of each chamber is pneumatically coupled to the second opening of such chamber and wherein a first chamber has an air-actuated noisemaking device therein, and wherein a second chamber contains no noisemaking device; and a cover positioned at the second end and configured to selectively and alternatively cover the second opening of one of the chambers such that air only flows through any chamber having a second opening not substantially covered by the cover.

10. The shoe as recited in claim 9, wherein the squeaker is on when the cover is positioned over the second opening of the second chamber and wherein the squeaker is off when the cover is positioned over the second opening of the first chamber.

11. The shoe as recited in claim 9, wherein the noisemaking device comprises a reed.

12. The shoe as recited in claim 11, wherein the reed is a bidirectional reed.

13. The shoe as recited in claim 9, wherein the cover is slidingly retained within a portion of a cap covering the second end of the air tunnel.

14. The shoe as recited in claim 9, wherein the squeaker is located in a heel portion of a sole of the shoe.

15. The shoe as recited in claim 14, wherein the air reservoir is centered in a heel portion of the shoe.

16. The shoe as recited in claim 9, wherein the air tunnel comprises two chambers.

* * * * *